US005914573A

United States Patent [19]

Lin

[11] Patent Number: 5,914,573

[45] Date of Patent: Jun. 22, 1999

[54] GO-GO LIGHT BELT INCLUDING SAWTOOTH WAVE OR STEP-WAVE TRIGGERED LAMP SECTIONS

[76] Inventor: Yuan Lin, No. 3-1, Ta Shui Chyueh, Tai Ma Li Hsiang, Tai Tung Hsien, Taiwan

[21] Appl. No.: 08/777,449

[22] Filed: Dec. 30, 1996

[51] Int. Cl.[6] ..... H05B 37/02

[52] U.S. Cl. ..... 315/315; 315/316; 315/312; 315/200 A; 362/806; 362/219; 362/227; 307/38; 307/41; 307/36

[58] Field of Search ..... 315/312, 313, 315/314, 315, 316, 323, 200 A; 362/800, 227, 226, 219, 806; 307/38, 41, 157, 36

[56] References Cited

U.S. PATENT DOCUMENTS 5,315,160 5/1994 Chang ..... 315/323 X

*Primary Examiner*—Arnold Kinkead
*Attorney, Agent, or Firm*—Bacon & Thomas

[57] ABSTRACT

An electrical go-go light belt includes a sawtooth or step-wave generator. The sawtooth or step-wave is transmitted to a lamp section via a drive line, the voltage of the rising sawtooth or step-wave being supplied to a voltage divider to trigger silicon controlled rectifiers and turn on any bulbs that are connected in series with the rectifiers one by one. The rearmost bulb in a preceding lamp section is turned on to trigger the sawtooth or step-wave generator of the relay circuit of the next lamp section so as to turn on the bulbs of that section, the last bulb of which triggers the sawtooth or step-wave relay of a further section, and so forth. A control system regulates the frequency of the sawtooth or step-waves emitted by the sawtooth or step wave generator of the current lamp section, and the relay circuits, in order to control the rate at which bulbs are turned on. When the rearmost bulb of the last lamp section is turned on, the turn-off system is triggered to output a turn-off signal to the control system, and the control system outputs a low voltage to make all the bulbs of the belt turn off. When it is desired to add more lamp sections, it is simply necessary to install additional relay power supplies, permitting the belt to be extended indefinitely.

6 Claims, 11 Drawing Sheets

TURN-OFF SIGNAL GENERATOR

GO-GO LIGHT BELT INCLUDING SAWTOOTH WAVE OR STEP-WAVE TRIGGERED LAMP SECTIONS

FIELD OF THE INVENTION

This invention relates to an electrical go-go light belt, and in particular to a structure in which the sawtooth-wave or step-wave voltage generated by a control system is transmitted to a lamp section via a driving line, the voltage of the rising sawtooth wave or step-wave forms a trigger voltage on a divider in order to trigger a silicon controlled rectifier (SCR), and then the bulbs which are connected in series with the positive pole of the SCR turn on one by one. The rearmost bulb in the preceding lamp section is turned on to trigger the sawtooth-wave or step-wave generator of the relay circuit of the present lamp section so as to emit a sawtooth-wave or step-wave which is useful for turning on the bulbs of the present lamp section. The control system can regulate the frequency of a sawtooth wave or step-wave emitted from the sawtooth-wave or step-wave generator of the lamp section and relay circuit in order to control the turn-on speed. When the rearmost bulb of the rearmost lamp section is turned on, the turn-off system is triggered to output a turn-off signal to the control system, and the control system outputs a low voltage to make all the bulbs of the go-go light belt turn off. If more lamp-sections are to be installed, one or more relay power supplies are mounted to replace the control system to provide electrical power to the lamp sections and relay circuits, and thus the go-go light belt can extend to an endlessly long distance.

BACKGROUND OF THE INVENTION

Currently, a well-known belt lamp flashes as a conventional revolving lamp does. The bulbs of the well-known belt lamp can not be turned on one by one, and the turn-on speed and the lighting duration of bulbs cannot be controlled. All the bulbs cannot be turned on simultaneously. To turn off the bulbs, the power must be turned off. Therefore, all the bulbs cannot be automatically turned off. All the bulbs cannot be turned off and sequentially turned on. The belt lamp cannot exhibit passive flashing. Furthermore, because a relay power supply is not installed, additive belt lamps cannot be turned on and the length of the belt lamp is limited. The ornamental lamp exhibition display does not vary but rather can only monotonously flash and is thus not useful for advertisement and ornament.

SUMMARY OF THE INVENTION

It is an object of present invention to provide an electrical go-go light belt having writing, and versatilely ornamenting functions. The functions are achieved by generating a sawtooth-wave or step-wave voltage in the control system, triggering the SCRs in the present lamp section in order to turn on one by one the bulbs in series with the SCRs, and triggering the relay circuit in the next lamp section by the turning on of the rearmost bulbs of the present lamp section so as to sequentially drive and turn on the bulbs of the next lamp section.

It is another object of the present invention to provide a turn-on control method which is achieved by emitting a frequency control signal in order to control the turning on of the bulbs of the go-go light belt.

It is another object of present invention to provide a new automatic turn-off function for the go-go light belt which is achieved by outputting a turn-off signal from the turn-off system to the control system.

It is another object of present invention to provide an endlessly long go-go light belt by installing a relay power supply to provide electrical power to additive lamp sections connected in series with the next lamp section.

This invention is characterized in that the sawtooth-wave or step-wave g generator of the control system outputs a sawtooth-wave or step-wave voltage to a voltage amplifier and driver, the amplified sawtooth or step waves being transmitted to a lamp section via a driving line, and transmitted to a voltage divider of the control unit so as to generate a trigger voltage useful for triggering the gate of an SCR and turning on the bulb connected in series. The trigger voltage useful for triggering the gate of the SCR increases along the sequence of the SCRs, the sawtooth or step wave voltage having a rising value to turn on each of the bulbs sequentially, the relay circuit in the next lamp section receiving the signal from the present lamp section which releases the inhibition state of the next lamp section after the rearmost bulb in the present lamp section is turned on and the rearmost control unit transmits the signal, after which the relay circuit of the next tamp section is triggered to emit a sawtooth-wave or step-wave in order to turn on the bulbs of the next lamp section. The turn-on speed is regulated by a speed controller, the speed controller emitting a control signal having a single variable frequency to control the frequency of a sawtooth-wave or step-wave generated by the relay circuit and the frequency of a sawtooth-wave or step-wave generated by the sawtooth or step-wave generator to control the turn-on speed of the bulbs. v When the rearmost bulb in the rearmost lamp section is turned on, a signal to release the inhibition state is transmitted to turn-off signal oscillator of the turn-off system, the oscillator of the turn-off system being triggered to output a turn-off signal to the control system, after which the sawtooth-wave or step-wave generator outputs a low voltage which cannot trigger the bulbs to be turned on, so all the bulbs of the go-go light belt are turned off, and the full-on time controller and the full-off time controller can control the holding duration of the full-on or full-off. A relay power supply is installed to provide electrical power to the other tamp sections and relay circuits, so that the go-go light belt can extend to endlessly long, distance.

DETAILED DESCRIPTION OF THE INVENTION

Figure 1A:
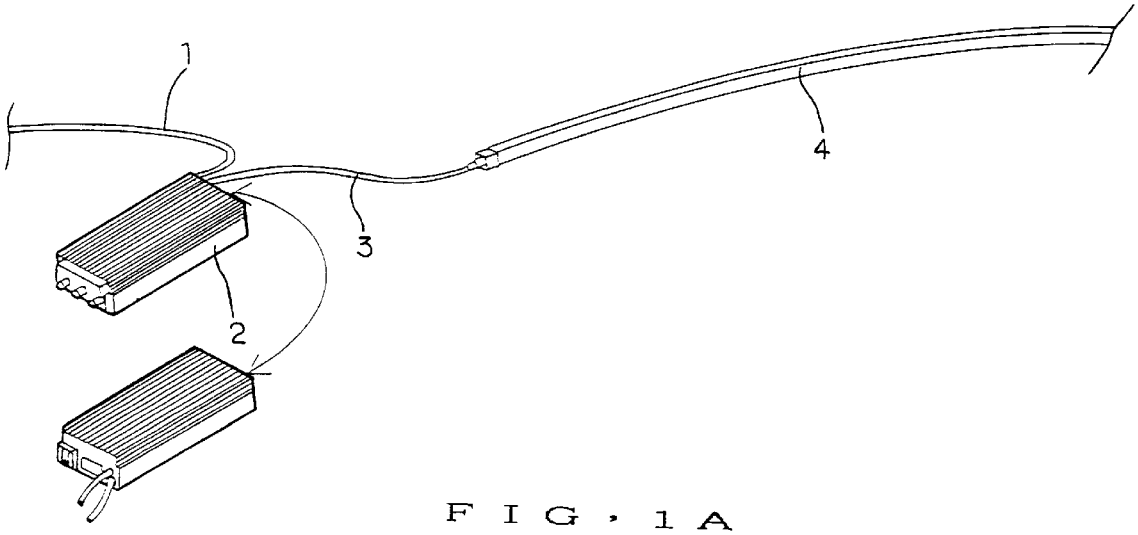
FIG. 1A is a perspective view of the go-go light belt of the present invention.
Figure 1B:
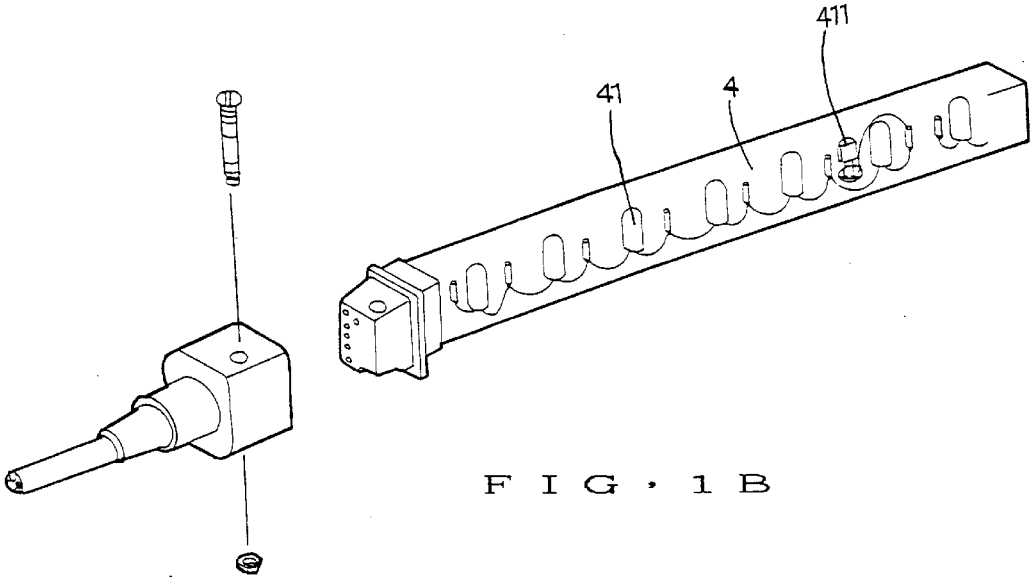
FIG. 1B is a three-dimensional view of the first lamp section of the Go-go light belt of the present invention.

As shown in FIGS. 1A, 1B, and 2–5, the go-go light belt of present invention comprises a control system (2), a lamp section (4), a relay circuit (5), a relay power supply (6) and a turn-off system (8). A power line (1) provides electrical power to the go-go light belt. A transmission line transmits a signal between the lamp section (4) and the control system (2). If other lamp sections are to be connected to the first lamp section (4), a relay power supply (6) should be installed to provide electrical power via power line (61). A T-type connector (7) is arranged between the relay power supply (6) and the lamp section (4).

Figure 2:
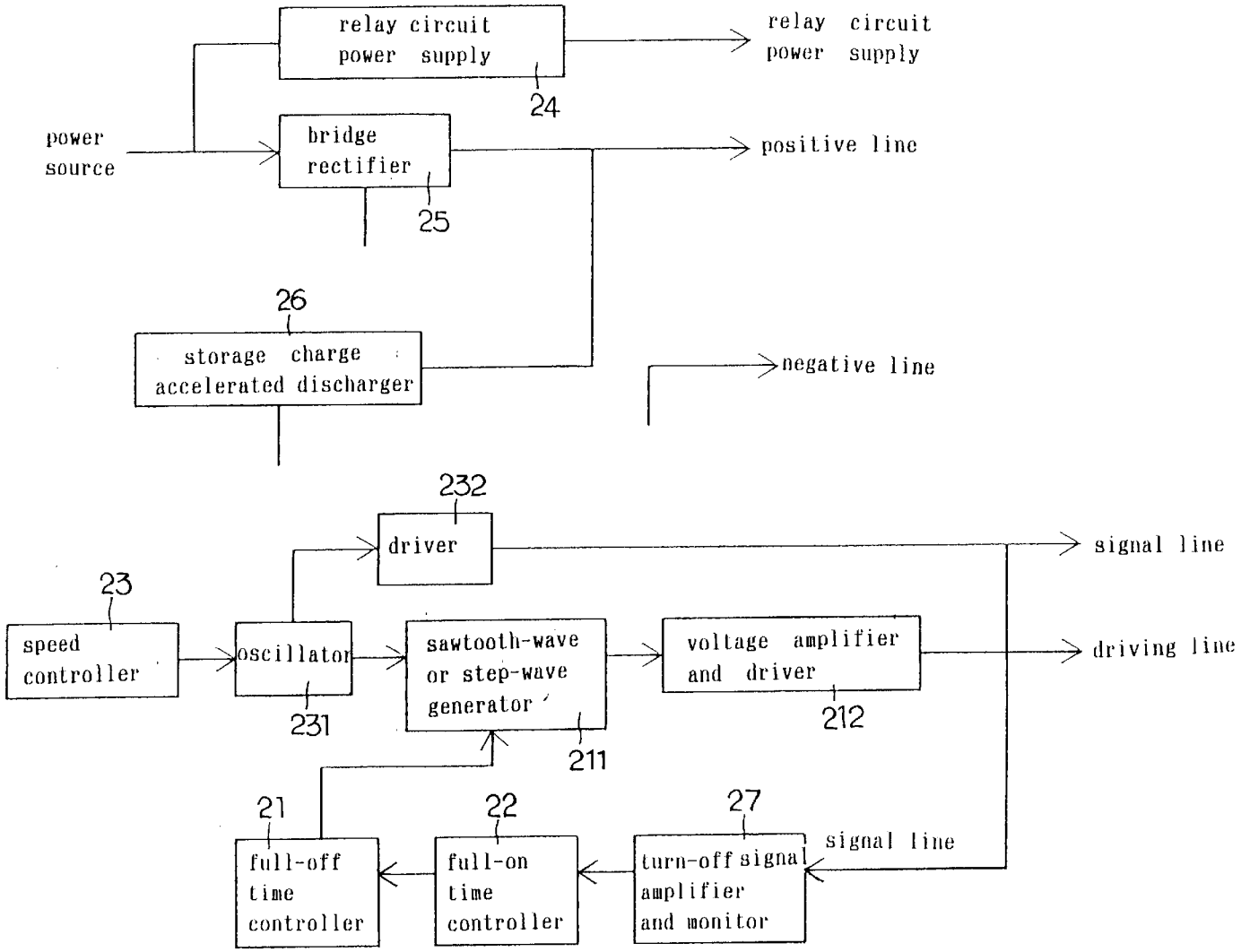
FIG. 2 is a block diagram of the control system of the go-go light belt of the present invention.

FIG. 2 shows a block diagram of the control system(2) of the go-go light belt.

In the control system (2), an oscillator (231) generate pulses to trigger a sawtooth-wave or step-wave generator (211) to output a sawtooth waves or step waves which are amplified by voltage amplifier and driver (212). The amplified sawtooth-waves or step-waves are transmitted to a control unit via a driving line. The sawtooth waves or step waves form a trigger voltage on a voltage divider circuit to trigger a silicon controlled rectifier. A speed controller (23) regulates the pulses generated by the oscillator (231) to control the frequency of the sawtooth waves or step waves emitted by sawtooth-wave or step-wave generator. The oscillator (231) will force the driver (232) to emit a frequency-regulating signal which is transmitted to the relay circuit (5) via a signal line. The sawtooth-wave or step-wave generator (52) receives the frequency-regulation signal to regulate the frequency of the emitted sawtooth waves or step waves so as to control the speed of turning on the bulbs. When the signal line transmits the turn-off signal emitted by turn-off system (8), the frequency-regulating signal is not transmitted through the signal line. The turn-off signal amplifier and monitor (27) checks the received turn-off signal, and when checked out, the full-on time controller (22) and full-off time controller(21) control the holding duration by using a delay time method, after which a signal is emitted to trigger the sawtooth-wave or step-wave generator (211) to output a low voltage and the bulb of the go-go light belt turns off immediately. The AC power source is connected to the bridge rectifier (25) and the bridge rectifier (25) outputs a forward rectified voltage which is transferred to lamp section (4) via a positive line(+) while the ground voltage is output from the bridge rectifier (25) to the lamp section (4) via negative line(−). A storage charge accelerated discharger (26) may be provided as aa auxiliary device which is useful for providing rapid discharge to assist the SCR (42) in carrying out the turn-off action. The relay circuit power supply (24) provides electrical power to relay circuit (5) through a relay circuit power line.

Figure 3:
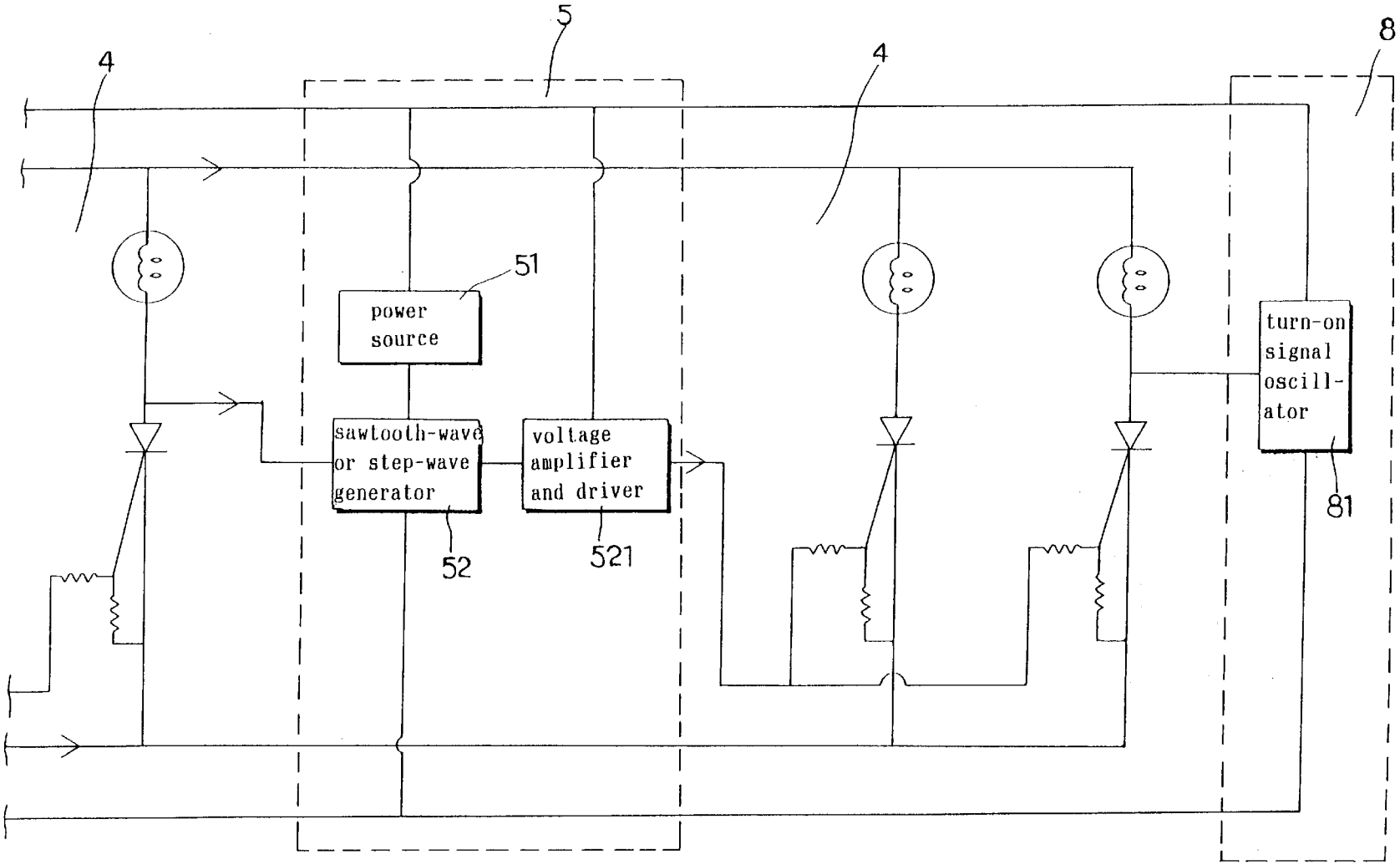
FIG. 3 is a perspective view of the lamp section of the go-go light belt of the present invention.

FIG. 3 shows the structure of the lamp section (4) of the go-go light belt. In the lamp section (4) the control system (2) transmits a sawtooth-wave or step-wave voltage via a driving line to the voltage divider circuit (43) which is composed of two resistors in the control unit to generate a triggering voltage, and then the electrical switch of an SCR (42) is triggered to become conductive, and the bulb which is connected in series to the positive pole of SCR (42) turns on. Because the triggering voltages increase along the sequence of bulbs, each of the bulbs turns on as the sawtooth-wave or step-wave voltage is applied to the voltage divider circuits. The speed of turning on the bulb is determined by the frequency-regulating signal transmitted from the control system (2) via a signal line. The negative pole of the SCR (42) is connected to the negative line(−) which is connected to control system (2). When the rearmost bulb in the present lamp section turns on, a signal to release the inhibition state is output to the sawtooth-wave or step-wave generator of the relay circuit (5) of the next lamp section.

Figure 4:
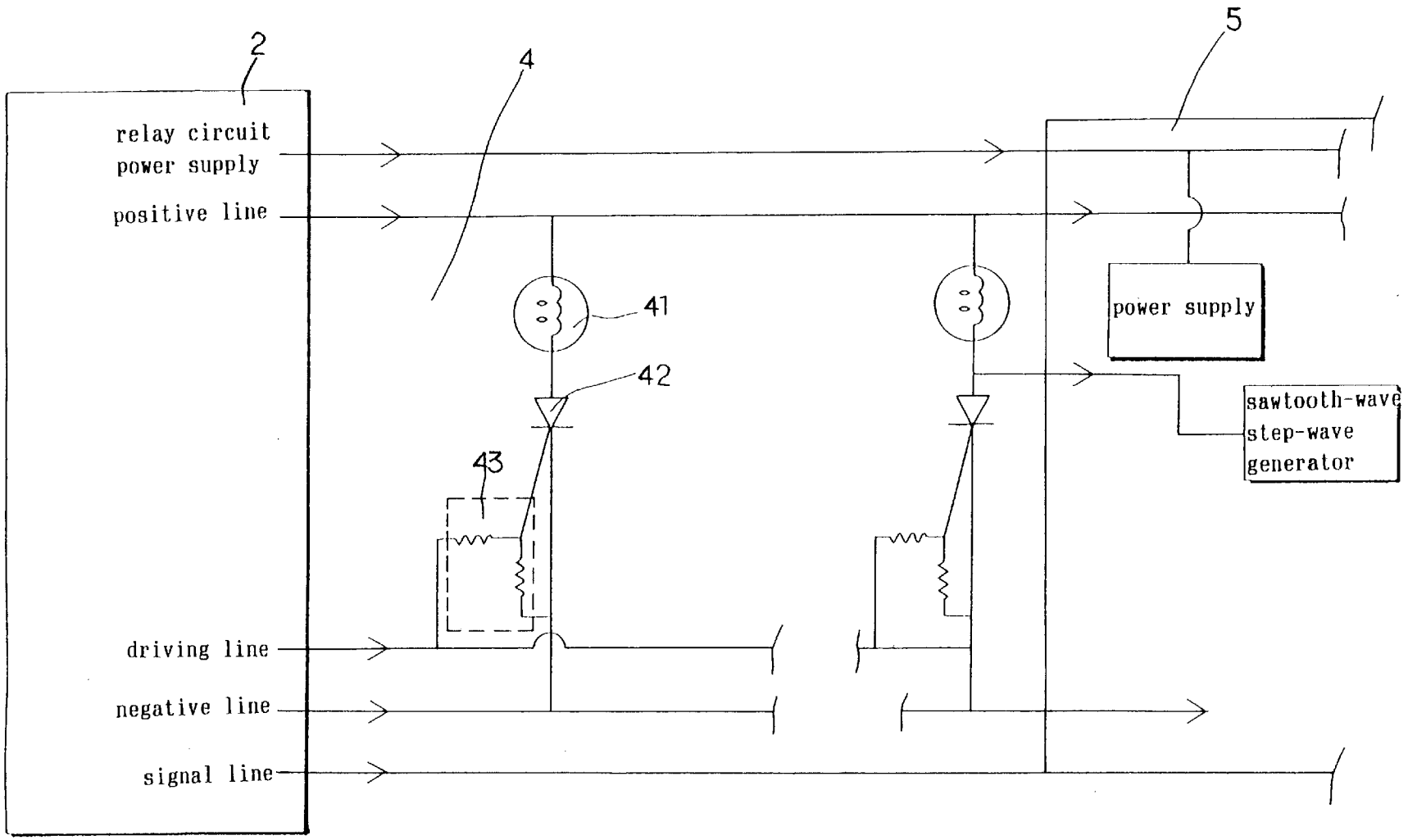
FIG. 4 is a block diagram of the relay circuit and turn-off system of the Go-go light belt of the present invention.

FIG. 4 shows the structure of the relay circuit (5) and turn-off circuit (8) of the go-go light belt. The power supply (51) of the relay circuit (5) receives the electrical power from the power supply (24) of the control system (2) and provides electrical power to sawtooth-wave or step-wave generator (52), which receives the signal to release the inhibition state from the preceding lamp section and which is triggered to output a sawtooth wave or step wave which is supplied to the voltage amplifier and driver(521) to generate a sawtooth-wave or step-wave voltage, which in turn is supplied to the voltage amplifier and driver (52) and transmitted to the lamp section via the driving line to turn on the bulb(41) so that the function and effect of triggering and driving, another next lamp section is accomplished. When the rearmost bulb of the last lamp section turns on, a signal to release the inhibition state is output to turn-off system (8), triggering the turn-off signal oscillator (81) to emit a turn-off signal which is transmitted to control system (2) via the signal line to control the holding duration of all bulbs turning on (full-on) or all bulbs turning off (full-off).

Relay power supply (6) provides electrical current to a plurality of lamp sections (4) and to relay circuit (5) when appropriate to supply electrical power so that an endlessly long light belt can be turned on.

Figure 5:
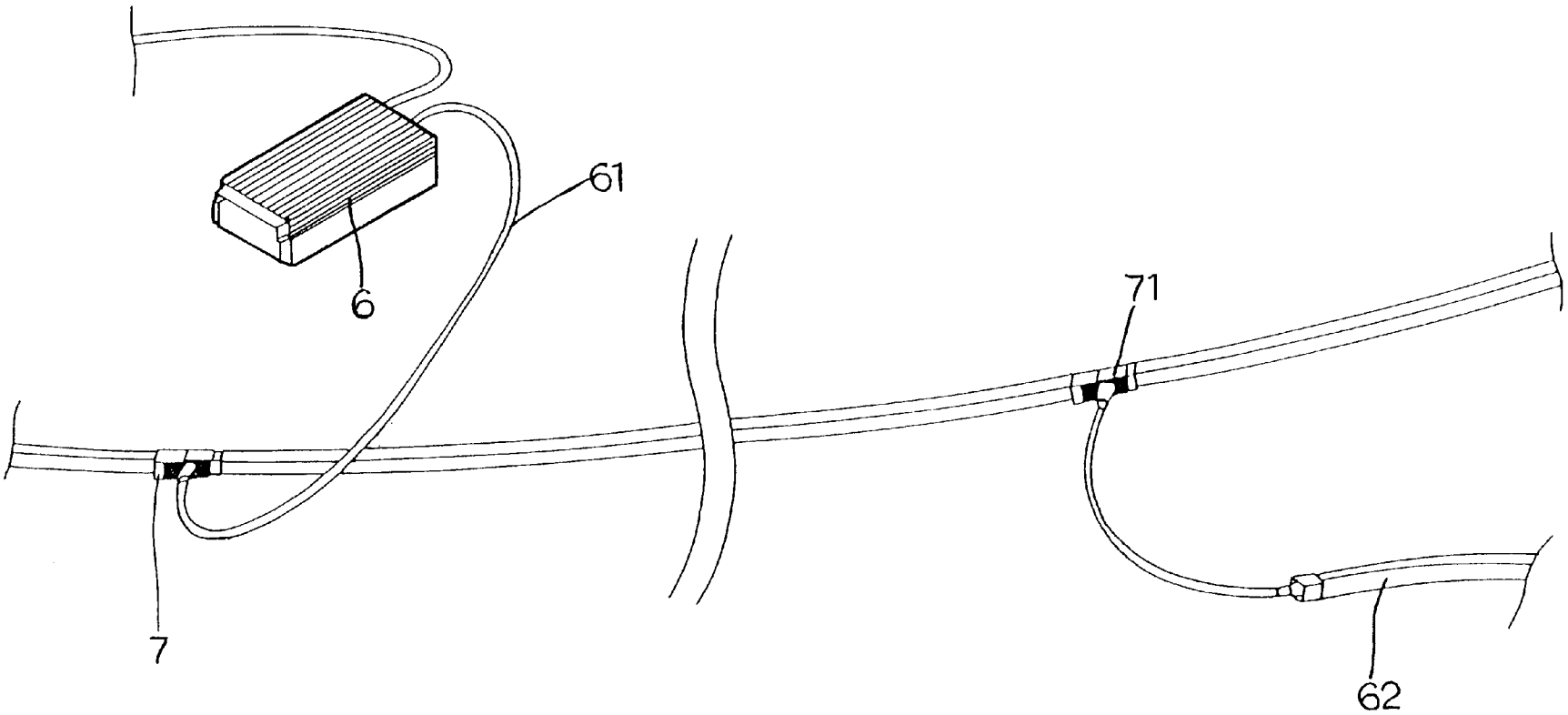
FIG. 5 is a schematic view of the relay power supply of the present invention.

In FIG. 5, the line (61) of relay power supply (6) provides the electrical power to a next lamp section. A T-type connector (71) can be connected between two lamp sections to branch to a branch lamp section (62).

Figure 6A:
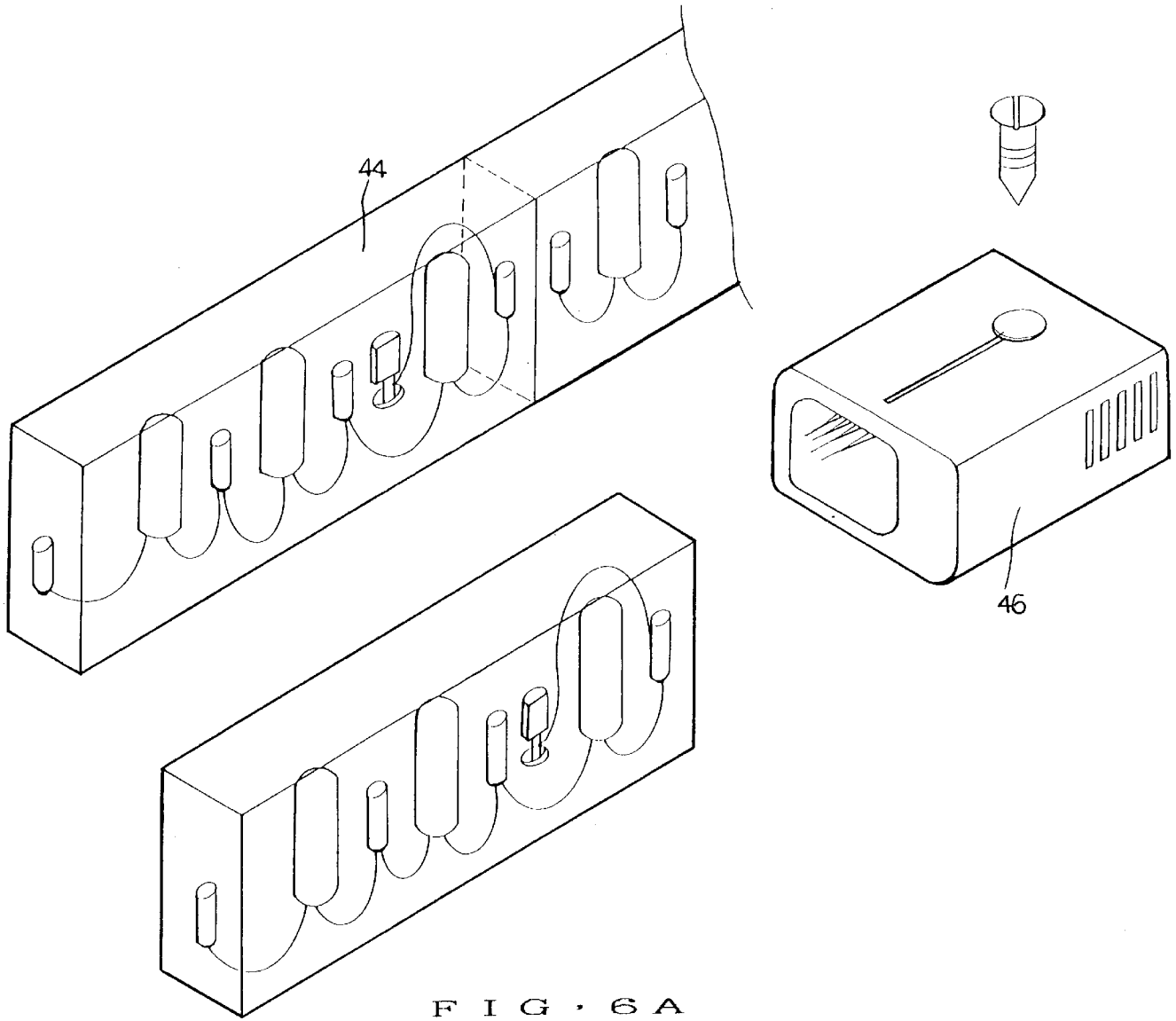
FIG. 6A is a three-dimensional view of the end signal generator of example 1 of the present invention.
Figure 6B:
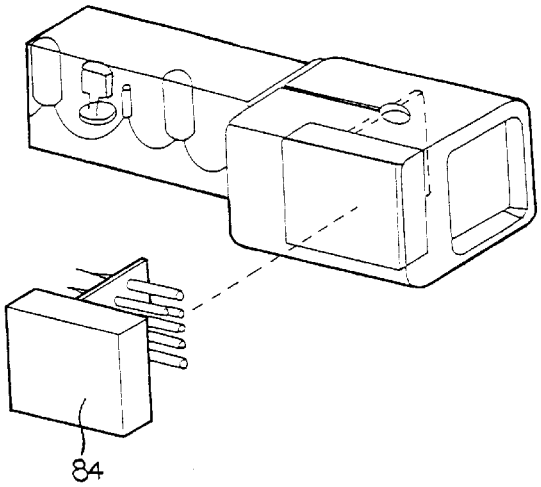
FIG. 6B is a three-dimensional view of the end signal generator of example 2 of the present invention.

In FIG. 6A, lamp section (44) is cut off and is inserted into an end signal generator (46). In FIG. 6B, an end signal generator (84) is positioned in the female side of a lamp section.

Figure 7A:
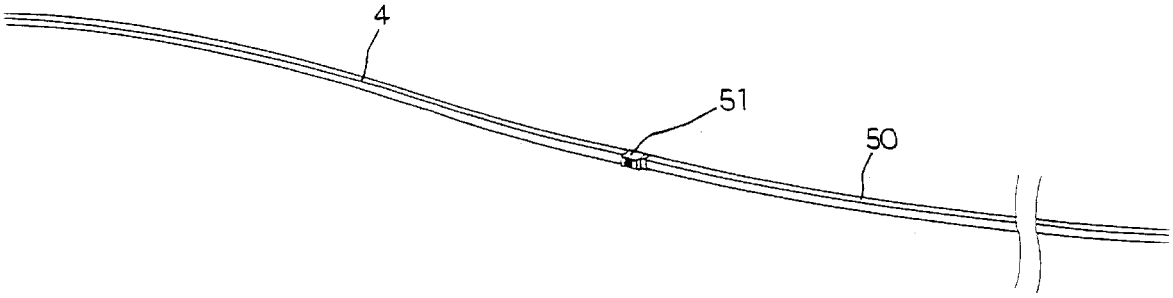
FIG. 7A is a three-dimensional view of a lamp section and the next lamp section of the present invention.
Figure 7B:
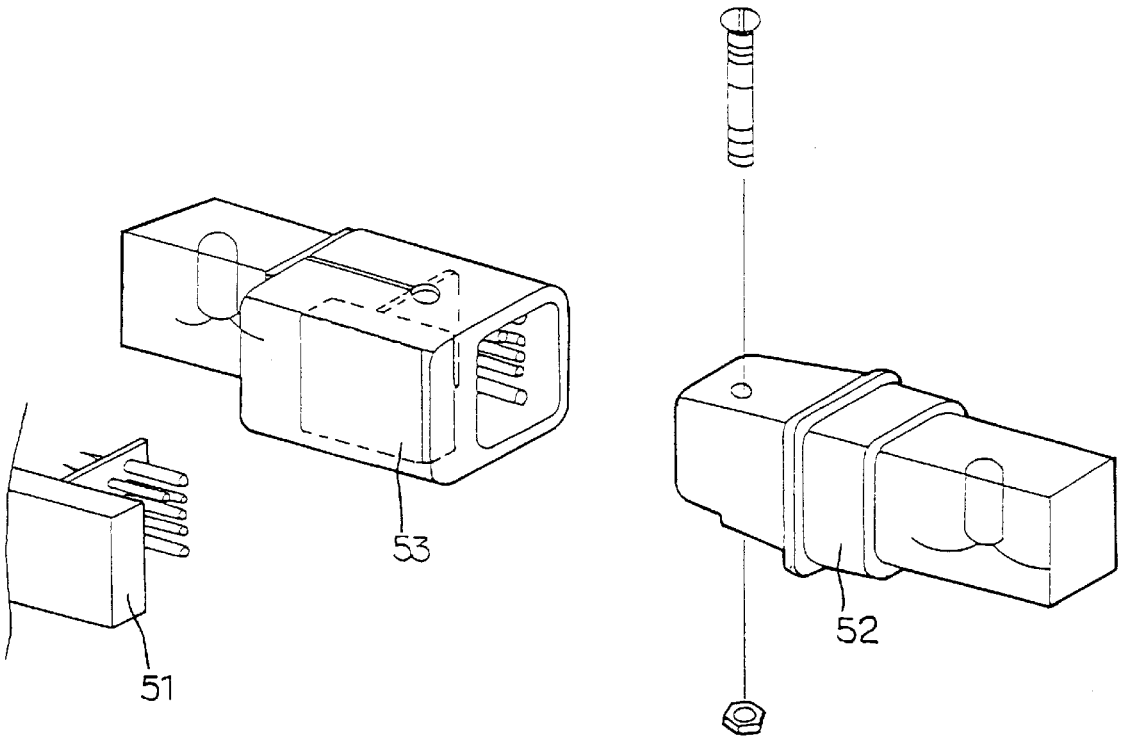
FIG. 7B is a three-dimensional view of the connector between a lamp section and the next lamp section of the present invention.

In FIG. 7A, between a first lamp section (4) and a second lamp section (50) is a relay (51) in the female side of a lamp section. In the relay (51) is a relay circuit (50). In FIG. 7B, the male side (52) of a lamp section can be inserted into the female side of another lamp section. The male side can be fixed to the female side by a screw.

Figure 8:
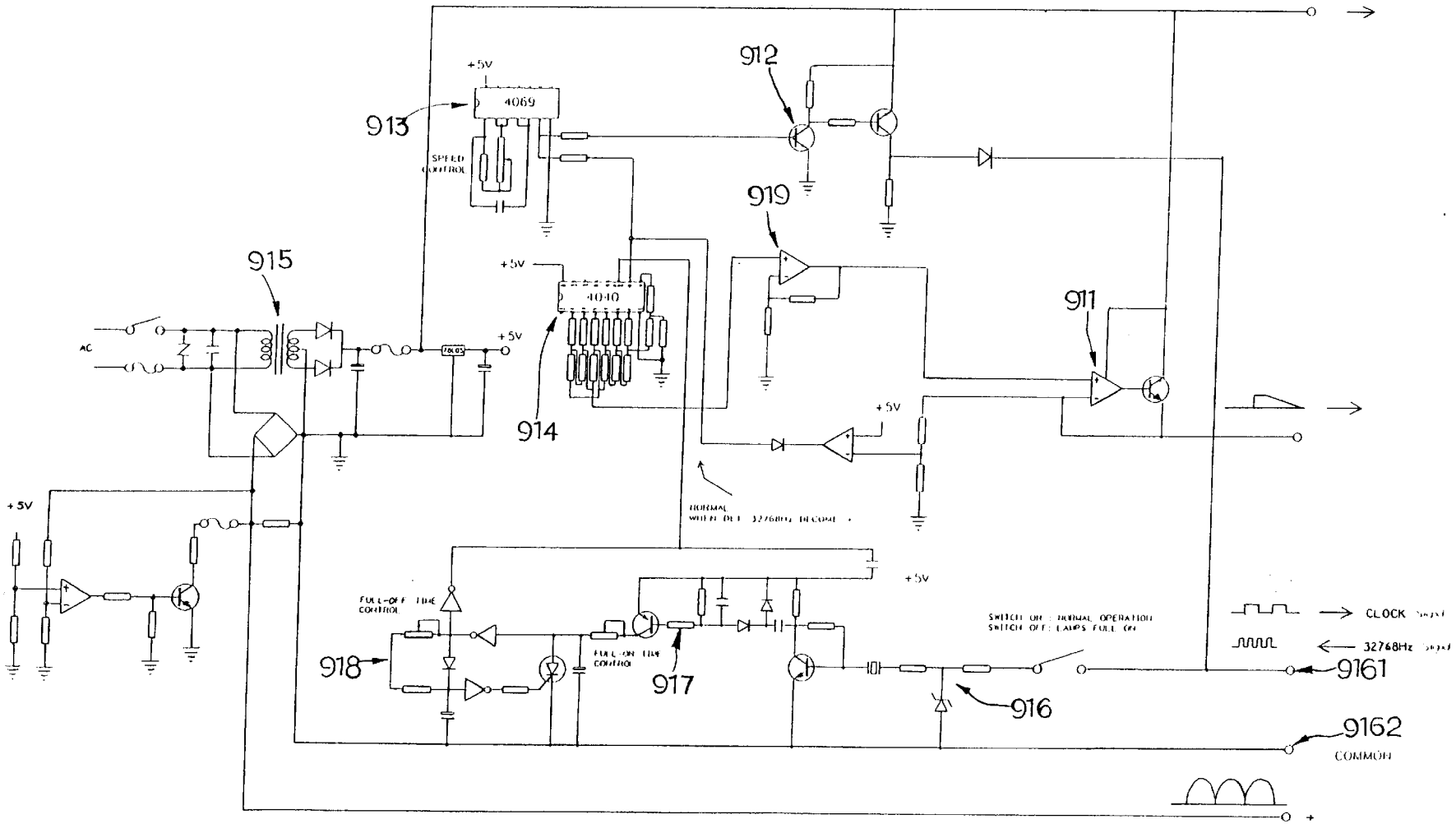
FIG. 8 is a circuit drawing of the control system of the go-go light belt of present invention.

In FIG. 8, the frequency of the emitted sawtooth wave or step wave Generated by sawtooth-wave or step-wave generator (914) is controlled by speed controller(9*l'i*). The sawtooth-wave or step-wave signal emitted by sawtooth-wave or step-wave generator (914) is amplified by voltage amplifier(919), then current amplified by driver (911) to be transmitted to an SCR. The turn-off signal amplifier and monitor (916) detect the turn-off signal, which is 32768 Hz signal (9161), and then the full-on time controller (917) and full-off time controller(918) control the action of turning on and turning off of go-go light belt, e.g., delay time, holding duration, etc. The power supply (915) provides the working power to the above circuits.

Figure 9:
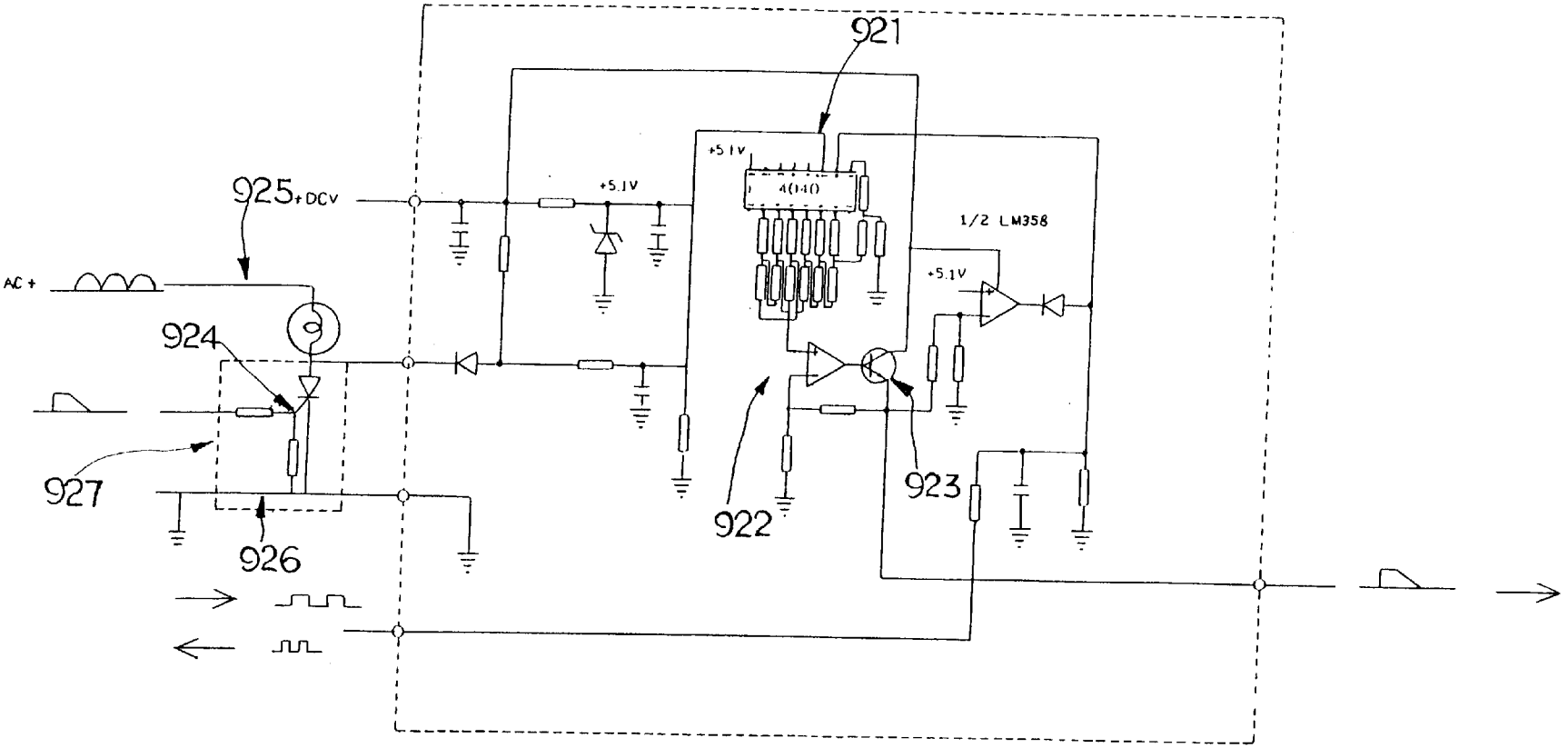
FIG. 9 is a circuit drawing of the relay circuit of the go-go light belt of present invention.

In FIG. 9, the voltage amplifier (922) amplifies the sawtooth-wave or step-wave signal emitted by sawtooth-wave or step-wave generator (921). The driver (923) is coupled to the output terminal of the amplifier (922). The amplified sawtooth-wave or step-wave signal emitted from driver (923) is transmitted to an SCR to drive the bulbs to turn on. The positive pole of the bulbs in the preceding lamp section is 925, and the negative pole is 926.

Figure 10:
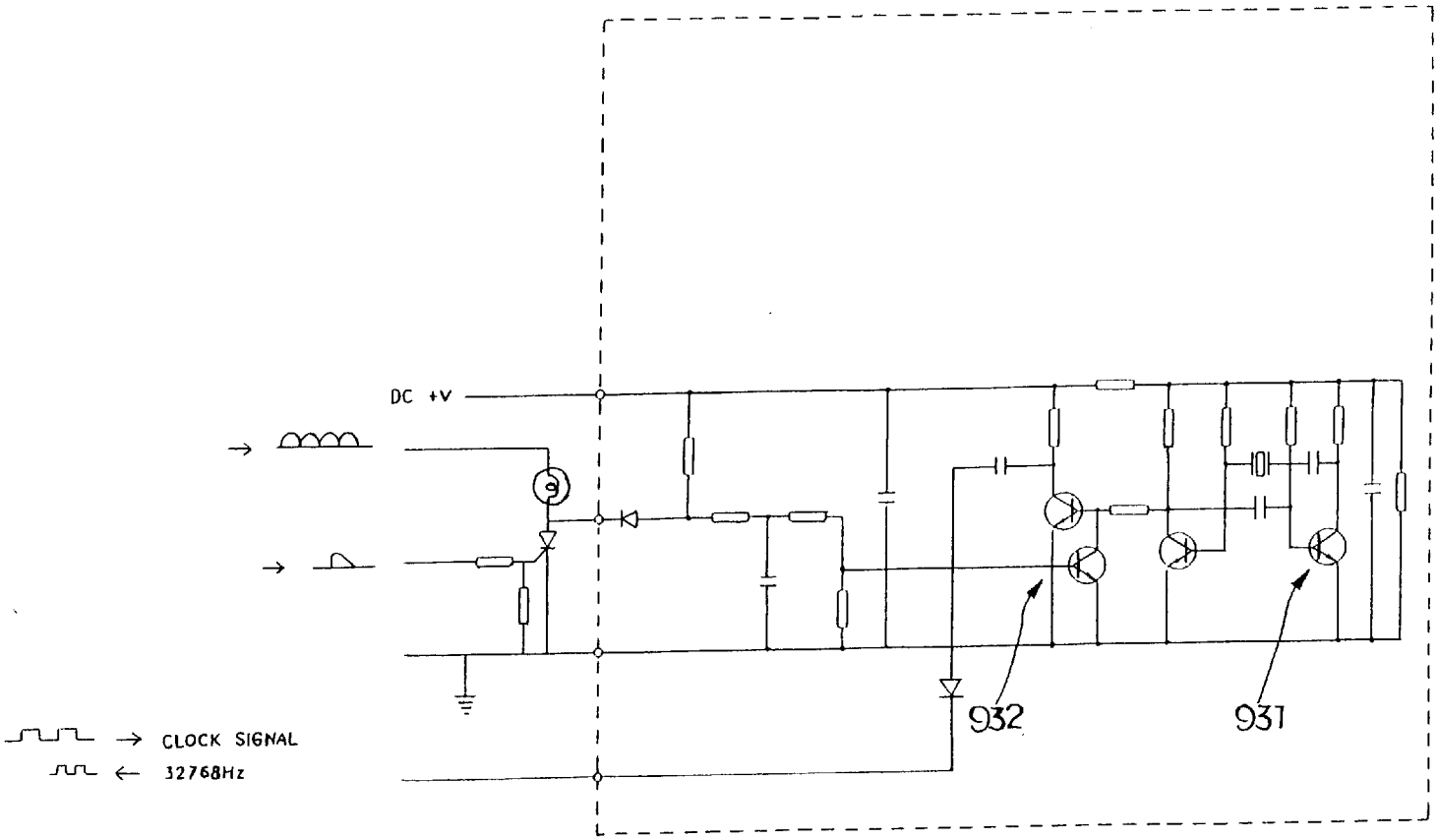
FIG. 10 is a circuit drawing of the turn-off system of the go-go light belt of present invention.

In FIG. 10, the turnoff signal oscillator (931) generates oscillating waves which are then driven by driver (932) when an inhibition-releasing signal is received and a 32768 Hz turnoff signal generated.

The go-go light belt of this invention has the following advantages:

(1) The rising sawtooth-wave or step-wave voltage triggers one by one the bulbs in a lamp section.

(2) The speed of running on all the bulbs can be regulated.

(3) The holding duration of full-on and fall-off can be automatically controlled.

(4) The relay circuit carries out the sequential turning-on of a next lamp section.

(5) The installation of relay power supplies can extend the go-go light belt to an endless distance.

Although the present invention has been described in detail, it should be understood that various chances, substitutions and alterations can be made thereto without departing from the spirit and scope of the present invention as defined by the appended claims.

I claim:

1. An electrical go-go light belt having a plurality of lamp sections, comprising:

a control system for outputting a sawtooth-wave or step-wave voltage to control a turning on speed of bulbs in the lamp sections, and a full-on and full-off holding duration of the lamp sections;

a relay circuit in each lamp section receiving said sawtooth-wave or step-wave voltage and for driving the bulbs of a next lamp section to turn on, each of said plurality of lamp sections having a plurality of bulbs which can be sequentially turned on one by one in response to the sawtooth-wave or step-wave voltage from the control system supplied through said relay circuit; and a turn-off system which, upon receiving a signal from the rearmost bulb of the last lamp section, generates a turn-off signal which is transmitted to the control system to automatically turn off all of the bulbs of the go-go-light belt.

2. The electrical go-go light belt of claim 1, further comprising one or more relay power supplies to provide electrical power to added lamp sections so that the length of the light belt can extend to a desired length.

3. The electrical go-go light belt of claim 1, wherein an oscillator of the control system triggers a sawtooth-wave or step-wave generator to output a rising sawtooth-wave or step-wave voltage, which is then amplified and output to a lamp section to turn on the bulbs one by one, and a speed controller outputs a control signal to regulate the frequency of the sawtooth-wave or step-wave triggered by the oscillator of the control system or by one of said relay circuits so that the speed of turning on the bulbs one by one can be controlled, and further comprising a relay power supply that provides electrical power to the relay circuits and bridge rectifiers for providing electrical power to the lamp sections, a turn-off signal amplifier and monitor for receiving said turn-off signal, and means for causing the sawtooth-wave or step-wave generator to output a low voltage to turn off all the bulbs of the go-go light belt and thereby control a full-on time and full-off time.

4. The electrical go-go light belt of claim 1 wherein a control unit is included in each of said lamp sections, said control unit being composed of a plurality of resistors and a SCR for turning on and turning off the bulbs, the sawtooth-wave or step-wave voltage generated by the control system being supplied to a voltage divider which is composed of said plurality of resistors, said voltage divider forming a triggering voltage to trigger the SCR to conduct and cause the bulb connected in series to the positive pole of the SCR to be turned on, wherein the triggering voltage increases as the sawtooth-wave or step-wave voltage rises gradually so that each control unit is triggered to turn on each bulb sequentially of said lamp section such that the turn-on speed is regulated by the control system.

5. The electrical go-go light belt of claim 1, wherein a plurality of the relay circuits include a relay circuit sawtooth-wave or step wave generator and the sawtooth-wave or step-wave generator of each said relay circuit receives a signal from the rearmost bulb in the preceding section upon turning on, and then outputs a sawtooth-wave or step-wave to a voltage amplifier and driver to drive the next lamp section to be turned on, the frequency of the sawtooth-wave or step-wave output by the sawtooth-wave or step-wave generator of each relay circuit being regulated by the control system.

6. The electrical go-go light belt of claim 1, wherein when a turn-off signal oscillator of the turn-off system receives a signal from the rearmost bulb of the last of the lamp sections which is to be turned on, then the turn-off signal oscillator is triggered to transmit a turn-off signal to the control system in order to turn off all the bulbs of the go-go light belt.

* * * * *